United States Patent [19]

Debona et al.

[11] 4,296,669

[45] Oct. 27, 1981

[54] ROCKET TUBE LAUNCHER WITH CAST-IN PLACE TUBE SUPPORT BULKHEAD

[75] Inventors: Edward J. Debona; Boyd L. Neblett; Walter J. Krueger; William J. Laird; Billy H. Campbell; Gerald H. Matthews, all of Huntsville, Ala.

[73] Assignee: The United States of America as represented by the Secretary of the Army, Washington, D.C.

[21] Appl. No.: 42,667

[22] Filed: May 25, 1979

[51] Int. Cl.[3] ..... F41F 3/04

[52] U.S. Cl. ..... 89/1.816; 29/1.11

[58] Field of Search ..... 29/1.11; 89/1.816, 1.819, 89/1.806, 1.807, 1.817

[56] References Cited

U.S. PATENT DOCUMENTS

| | | | |
|---|---|---|---|
| 3,702,090 | 11/1972 | Hoard | 89/1.816 X |
| 3,710,678 | 1/1973 | Abelin et al. | 89/1.816 |
| 3,754,497 | 8/1973 | Rusbach | 89/1.816 X |
| 3,841,197 | 10/1974 | Morrisey | 89/1.816 |
| 3,988,961 | 11/1976 | Banta et al. | 89/1.807 |

*Primary Examiner*—David H. Brown

*Attorney, Agent, or Firm*—Nathan Edelberg; Robert P. Gibson; James T. Deaton

[57] ABSTRACT

A rocket tube launcher in accordance with this invention includes a housing type pod assembly which has 30 launch tubes mounted and supported by front and rear bulkheads, two center bulkheads and closed-cellular foam that surrounds the tubes at a center portion and supports the center portion of the tubes. Each of the tubes is designed to have a rocket or missile launched therefrom.

7 Claims, 9 Drawing Figures

ROCKET TUBE LAUNCHER WITH CAST-IN PLACE TUBE SUPPORT BULKHEAD

DEDICATORY CLAUSE

The invention described herein may be manufactured, used, and licensed by or for the Government for governmental purposes without the payment to us of any royalties thereon.

CROSS REFERENCE TO RELATED APPLICATION

This application is related to copending application Ser. No. 933,312 filed Aug. 14, 1978, now U.S. Pat. No. 4,191,087, in that they are each related to structures for mounting and launching rockets.

BACKGROUND OF THE INVENTION

In the prior art, pod assemblies for launching a plurality of rockets are known; however, these devices do not have the ease of fabrication by a simple method as needed nor can they be made of as lighweight material as is desirable.

Therefore, it is an object of this invention to provide a rocket launcher that has a pod assembly that can be made of lightweight materials such as aluminum and in which the tubes of the pod assembly are supported at a center portion which will coincide with the center of gravity of rockets or missiles to be mounted therein and launched therefrom.

Another object of this invention is to provide a rocket launch tube assembly in which the tubes can be accurately aligned and maintained in alignment while being transported on a track vehicle.

Another object of this invention is to provide a rocket launch tube pod assembly in which a center portion of each of the tubes is mounted and supported by a closed-cell foam that surrounds each of the tubes to provide a unibody type structure about the tubes.

Another object of this invention is to provide a launch tube pod assembly in which a large number of tubes can be mounted, for example 30 tubes, in one assembly.

Other objects and advantages of this invention will be obvious to those skilled in this art.

SUMMARY OF THE INVENTION

An accordance with this invention, a rocket tube launcher and the method of making the rocket tube launcher is disclosed in which a multipart elongated housing is secured together with conventional securing means such as nuts and bolts, and with the elongated housing secured together, forward and rear bulkheads are secured at the forward and rear ends of the elongated housing. Intermediate bulkheads are secured near the center of the elongated housing, and an inner support structure is secured to the forward and rear bulkheads, the intermediate bulkheads and to opposite sides of the elongated housing to support the housing structure. Also, nut and bolt spacers and supports are mounted between inner bulkheads to maintain a substantially constant spacing between the inner bulkheads. Launch tubes are positioned in the forward and rear bulkheads in remote corners and aligned before the forward, rear and intermediate bulkheads are firmly secured into position relative to the elongated housing. The forward, rear and intermediate bulkheads each have openings therethrough which are adapted to have launch tubes mounted therein and the intermediate bulkheads have oversized openings therein. Once the bulkheads have been secured in position, a row of launch tubes are positioned in a horizontal direction at the bottom of the elongated housing and each of these launch tubes is boresighted and aligned before being secured to the rear bulkhead and the forward bulkhead. The tubes have caulking placed between the outer periphery of each tube and the oversized openings in the intermediate bulkheads and a liquid state foam is poured over and between the aligned tubes to fill all voids surrounding the tubes. After the first row is installed and aligned with the first foam poured therearound, the next row of tubes is installed and aligned just as the first row and the foam poured therearound as well. This is repeated until all the rows of tubes have been mounted and aligned, and finally when the last row has the foam poured therein, a cover is placed over the opening through which the foam is poured or injected. Therefore, it can be seen that the foam provides a unit type body structure for supporting the center portion of each of the launch tubes. Further, possession of this type structure enables the housing bulkheads and launch tubes to be made of light material such as aluminum. Also, assembly of the rocket tube launcher is assembled upside-down and then turned over for being placed in operation.

DESCRIPTION OF THE PREFERRED EMBODIMENT

Figure 1:
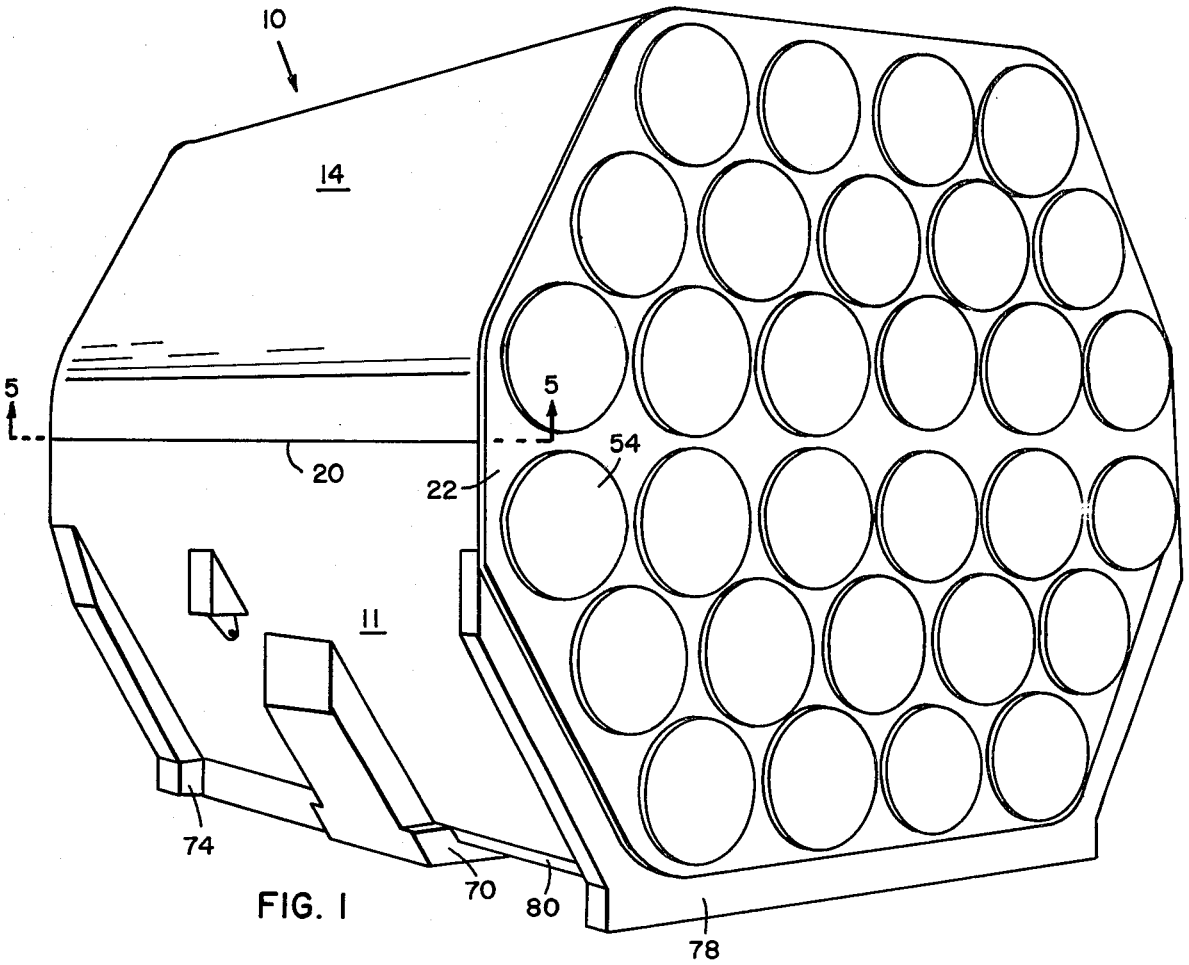
FIG. 1 is a perspective view illustrating the front and side of the rocket tube launcher in accordance with this invention.
Figure 5:
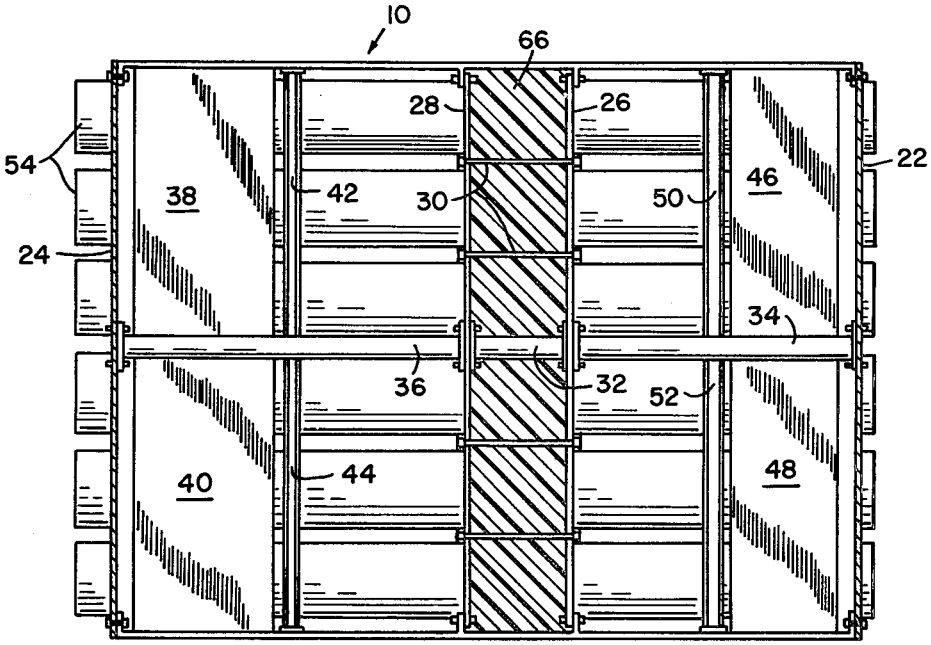
FIG. 5 is a sectional view along line 5—5 of FIG. 1.
Figure 2:
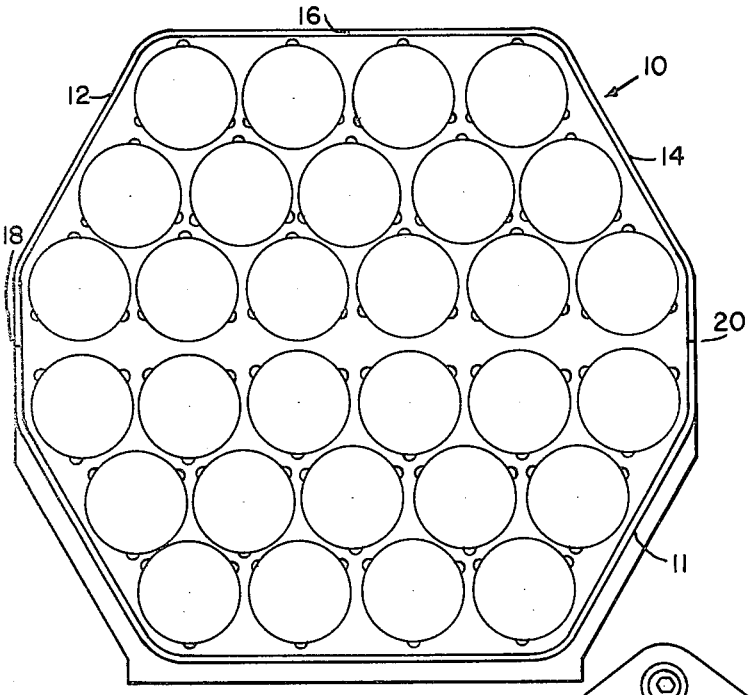
FIG. 2 is a schematic rear end view of the rocket tube launcher in accordance with this invention.
Figure 4:
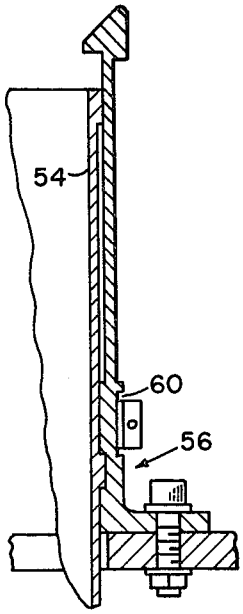
FIG. 4 is a sectional view along line 4—4 of FIG. 3.
Figure 3:
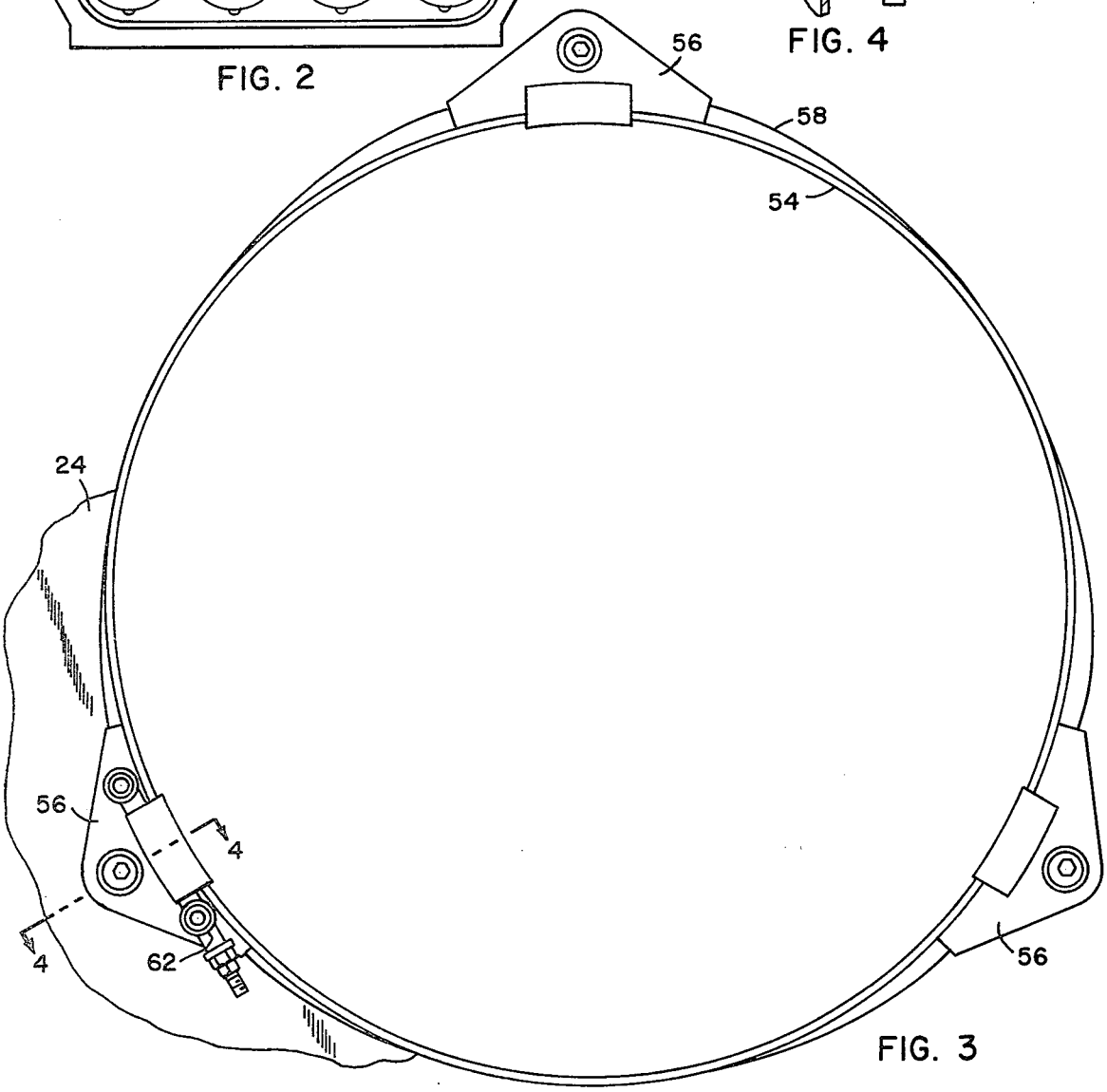
FIG. 3 is a detailed end view illustrating the mounting of the end of a single tube.
Figure 6:
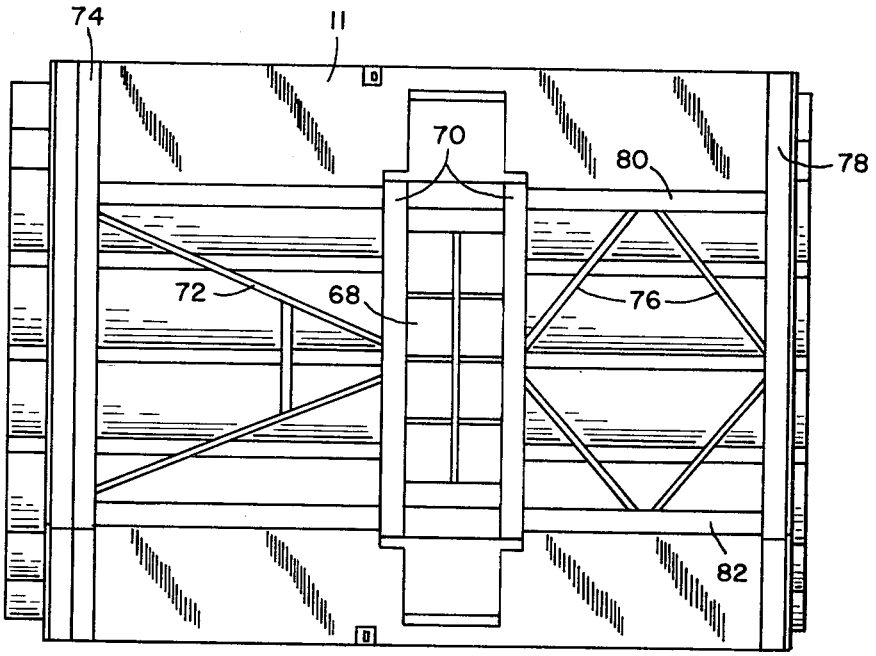
FIG. 6 is a bottom view of the rocket tube launcher in accordance with this invention.
Figure 8:
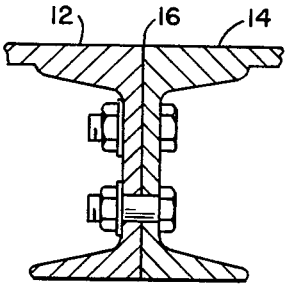
FIG. 8 is a sectional view illustrating a joint in the housing structure, and, FIG. 9 is an enlarged view illustrating details of the front of the launch tubes.
Figure 9:
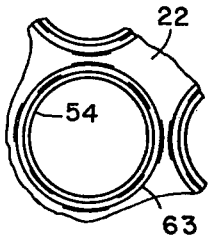

Referring now to the drawing, the launch tube mechanism of this invention includes an elongated housing that is made in three sections consisting of lower half 11, upper quarter section 12 and upper quarter section 14 (see FIG. 2). Upper sections 12 and 14 are secured together at joint 16 with flanges that are bolted together or by other conventional securing means as illustrated in FIG. 8. Upper sections 12 and 14 are secured to lower section 11 at joints 18 and 20 in a similar manner to that illustrated for joint 16. The forward end of housing 10 has bulkhead 22 secured thereto, the rear end of housing 10 has rear bulkhead 24 secured thereto and intermediate bulkheads 26 and 28 are secured in housing 10 in a conventional manner such as illustrated in FIG. 5. Bulkheads 26 and 28 have a plurality of nut and bolt arangements 30 for spacing intermediate bulkheads 26 and 28 to maintain a substantially constant spacing therebetween. Also, a center support section 32 and outer sections 34 and 36 are secured to intermediate bulkheads 26 and 28 and front and rear bulkheads 22 and 24 to support these structures. Also, the inner structure is further reinforced and supported by rear plates 38 and 40 that are secured in a conventional manner to tubular support 36 and to housing 10 in a conventional manner. Also, I beams 42 and 44 are secured to tube 36 and housing 10 in a conventional manner to provide additional structural support. At the forward end are support plates 46 and 48 that are secured in a conventional manner to housing 10 and forward tube 34 for structural support. Also, I beams 50 and 52 are secured to tube 34 and housing 10 in a conventional manner to complete the inner structural support for the housing. Each of bulkheads 22, 24, 26, and 28 have 30 holes or openings therethrough as illustrated from the pattern as depicted in FIGS. 1 and 2. These plates are drilled simultaneously by placing the four plates, one on top of the other, and drilling. Also, inner plates 26 and 28 are drilled to have oversized ports therein. Each of the ports has a launch tube 54 mounted therein and each tube is secured at the rear end by three equally spaced mounting means 56 as illustrated in FIGS. 3 and 4 and by band means 58 that engages groves 60 of mounting means 56 and by clamping means 62 that is at the ends of band 58 to clamp tube 54 to the rear end. For further details of the mounting means for the end of tubes 54, see copending application Ser. No. 933,312 filed Aug. 14, 1978, now U.S. Pat. No. 4,191,087. The forward ends of tubes 54, as illustrated in FIG. 9, are secured to forward bulkhead 22 by ring 62 that is approximately one inch long and welded to bulkhead 22 and the end of tube 54 after the tube has been aligned to secure the tube to the bulkhead as illustrated. Each of tubes 54 is mounted in this manner. After tubes 54 are welded in position, the front ends of the tubes are resized internally to remove any cylindrical imperfections that are produced by the wedling of ring 63 to bulkhead 22 and tube 54. Since the structures thus far defined are made of lightweight aluminum and since tubes 54 are relatively long, the center portions of tubes 54 must be supported structurely in order to withstand the weight of a rocket mounted therein with the structural support at the center being at the center of gravity of the rocket contained therein. In order to provide this support, a closed-cellular material 66, weighing approximately 7 pounds per cubic foot, surrounds each tube to form an inner unitary lightweight structure which is very stiff structurely and yet a lightweight section of support material for supporting the weight of the rockets mounted in tubes 54. As illustrated in FIG. 6, the section which contains material 66 has a cover 68 (see FIG. 6) which closes this section when material 66 has been mounted around tubes 54 and between bulkheads 26 and 28. Cover 68 is secured to bottom support structure 70 in a conventional manner such as by being bolted thereto. As can be seen from FIG. 6, bottom section 11 is open on either side of the center section with cover 68 and the rear open section having braces 72 at one end which are connected to support 70 and support 74 at the opposite end. Structural supports 76 are integrally secured to support 70, support 78, side support 80 and side support 82. As can be seen, this allows the elongated housing 10 when turned upside-down to be open so that a person can enter the elongated housing through these open spaces and allow a person to secure bulkheads 22, 24, 26 and 28 into elongated housing 10 prior to all of tubes 54 being mounted.

Figure 7:
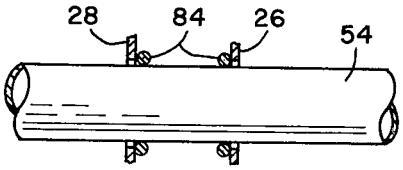
FIG. 7 is a schematic partially in section view illustrating sealing means around a central portion of a launch tube.

Referring now to FIG. 7, before mounting material 66 is placed between bulkheads 26 and 28, the oversize openings through which tube 54 passes have a caulking material placed around tube 54 and over the oversized opening in bulkhead 26 or 28 to seal this opening prior to material 66 being placed over and around tubes 54. Material 66 is a closed-cell foam material which weighs approximately 7 pounds per cubic foot and preferably is a material such as a polyurethane foam which rises quickly after it has been poured in and then sets up. Caulking material 84 is a polyproane material or other equivalent plastic materials. Caulking material 84 preferably has opposite ends secured together to form a continuous ring of the material.

In the method of fabrication and assembly, top sections 12 and 14 are secured together at joint 16 and bulkheads 22, 24, 26 and 28 are loosely secured at one side to upper section 12 and 14. This is done with upper section 12 and 14 turned bottom side up from that illustrated in FIG. 1. Then, lower section 11 is placed over sections 12 and 14 and secured together with sections 12 and 14 at joints 18 and 20. With this accomplished, bulkheads 22, 24, 26 and 28 are loosely secured to section 11 and inner support structures 32, 34, 36, 38, 40, 42, 44, 46, 48, 50 and 52 are secured by bolt means to bulkheads 22, 24, 26, 28 and elongated housing 10. Then, four tubes 54 are inserted through four of the openings in the bulkheads. These four tubes are the four end tubes at the upper and lower rows of tubes. These four tubes are aligned in a conventional manner and at this time bulkheads 22, 24, 26, and 28 are securely fastened to elongated housing 10 with these four tubes being maintained in an aligned condition. After this has been accomplished, two additional tubes 54 are inserted and aligned at the bottom with the elongated housing turned in the upside-down position and each of these tubes are aligned by being secured at the rear end and finally all four tubes in the bottom row are integrally secured to front bulkhead 22 by being welded thereto by ring 63 (See FIG. 1). With this row of tubes aligned and secured to the front and rear bulkheads, caulk material 84 is placed around each tube 54 to seal between tube 54 and each of the enlarged openings of bulkheads 26 and 28. Also, nut and bolt arrangements 30 can be inserted in place prior to caulk material 84 being placed about tubes 54 or they can be placed in bulkheads 26 and 28 after caulk material 84 has been installed for the first row of tubes. With the first row of tubes installed and secured in position, liquid foam 66 is poured between and around the outer surfaces of this bottom row of tubes and after it is poured in, it foams up and sets up in a hardened condition. With this accomplished and the foam being poured through the opening which exists when cover 68 is removed, the launch mechanism is now ready to have the next upper row of five tubes to be inserted through the bulkheads and aligned and finally secured to the front and rear bulkhead. Tubes 54 in this second row are then sealed with caulk 84 and finally foam material 66 is poured between and around this second row of tubes. This process is repeated for each row of tubes until the last and upper most row of four tubes are installed and foam poured therearound. When the foam has been poured around the last row of tubes, cover 68 is installed and secured in place to inclose the foam material. In this manner, a unibody structure of foam material is provided that is near the center of the launch tubes and in which this area coincides with the center of gravity of the rocket that is to be mounted in each of launch tubes 54 to thereby provide maximum support at the maximum point of stress on launch tubes 54. By utilizing the structure and fabrication as disclosed herein, the structural members including the tubes, housing and so forth can all be made of lightweight aluminum and the lightweight aluminum material can be structurally supported using foam means 66 as disclosed. Therefore, it can be seen that a relatively lightweight yet very rigid structure is provided in which a multiplicity of launch tubes can be mounted for the firing of rockets therefrom. Also, by utilizing a structure of this type, the structure is substantial enough for the rockets to be mounted therein and supported even during transporting thereof. It is also pointed out that foam means 66 is positioned so that the reaction point of the elevation mechanism used to raise and lower elongated housing 10 with the structure mounted therein will be at the place where the maximum amount of support is. That is, at the area where foam means 66 is. It is further pointed out that ring structure 62 that is used to secure the forward end of each tube 54 to bulkhead 22 stiffens the end of each launch tube 54 allowing it to withstand the rockets exhaust plume when a rocket is being fired from launch tube 54.

We claim:

1. A rocket tube launcher comprising an elongated housing structure having forward and rear ends, a rear bulkhead mounted at said rear end of said elongated housing structure, a forward bulkhead mounted at said forward end of said elongated housing structure, a pair of center bulkheads mounted in said elongated housing structure and being relatively close together relative to the spacing between said pair of center bulkheads and said forward and rear bulkheads; each of said rear bulkhead, said forward bulkhead, and said pair of center bulkheads having a multiplicity of openings therethrough with the openings of each bulkhead being aligned with the openings of each of the other bulkheads; a launch tube mounted in each of said openings and being welded to the forward bulkhead and secured to the rear bulkhead; rigid foam means of polyurethane foam mounted between said pair of center bulkheads and surrounding the launch tubes to provide a unibody structural support for the launch tubes near a center portion thereof, center structural support means secured to said front bulkhead, said rear bulkhead, said center bulkheads and said elongated housing structure to brace these members relative to each other, said front bulkhead, said rear bulkhead, and said pair of center bulkheads each being bolted to said elongated housing structure, and said pair of center bulkheads having bolt securing means at spaced positions about said center bulkheads to maintain a substantially constant spacing between said pair of center bulkheads.

2. A method of making a rocket tube launcher comprising the steps of assembling an elongated housing structure; securing forward, rear and a pair of intermediate bulkheads in an aligned arrangement to said elongated housing structure by aligning a multiplicity of alignable openings that are arranged in rows in each of said bulkheads, prior to said bulkheads being securely fastened to said elongated housing structure; mounting and aligning a row of launch tubes relative to said forward and rear bulkheads; casting an uncured foam material in a space about said aligned row of launch tubes that is between said pair of intermediate bulkheads; mounting and aligning other rows of launch tubes relative to said forward and rear bulkheads until all said alignable openings have launch tubes therein, and casting uncured foam material about each row of launch tubes at said space before the next row is mounted.

3. A method as set forth in claim 2, further comprising the steps of securing reinforcing means between the bulkheads and said elongated housing structure.

4. A method as set forth in claim 3, further comprising the step of placing caulking around each launch tube adjacent each of said inner bulkheads to seal between said inner bulkheads and each launch tube, said caulking step being done before said casting of the uncured foam material.

5. A method as set forth in claim 4, wherein said mounting of said launch tubes includes the steps of gimbaling each tube at the rear bulkhead by mechanical securing means and the step of welding a ring to the front end of each launch tube and said forward bulkhead.

6. A method as set forth in claim 5, wherein said forward, rear and pair of intermediate bulkheads are secured to said elongated housing structure by bolting the bulkheads to the elongated housing structure.

7. A method as set forth in claim 6, further comprising the step of sealing the space between the pair of intermediate bulkheads after the last row of launch tubes have had the uncured foam material cast thereabout.

* * * * *

UNITED STATES PATENT AND TRADEMARK OFFICE

CERTIFICATE OF CORRECTION

PATENT NO. : 4,296,669

DATED : Oct 27, 1981

INVENTOR(S) : Edward J. DeBona; Boyd L. Neblett; Walter J. Krueger; William J. Laird; Billy H. Campbell; Gerald H. Matthews It is certified that error appears in the above—identified patent and that said Letters Patent is hereby corrected as shown below:

In the "Inventors" change "Debona" to read - - DeBona - -.

Signed and Sealed this

*Eighteenth* Day of *May 1982*

[SEAL]

*Attest:*

GERALD J. MOSSINGHOFF

*Attesting Officer*

*Commissioner of Patents and Trademarks*